United States Patent [19]

Dempsey et al.

[11] 4,188,034

[45] Feb. 12, 1980

[54] SKILL BOARD GAME

[76] Inventors: Leonard H. Dempsey; Linda S. Adrian, both of 13217 1st South, Seattle, Wash. 98134

[21] Appl. No.: 856,303

[22] Filed: Dec. 1, 1977

[51] Int. Cl.[2] ..... A63F 3/00

[52] U.S. Cl. ..... 273/248; 273/280; 273/284; 273/145 C

[58] Field of Search ..... 273/145 C, 145 CA, 230, 273/234, 248

[56] References Cited

U.S. PATENT DOCUMENTS

| | | | |
|---|---|---|---|
| 2,191,991 | 2/1940 | Lloyd | 273/284 |
| 2,639,153 | 5/1953 | Murray | 273/145 C |
| 2,811,361 | 10/1957 | Woolrich, Jr. | 273/284 |
| 3,010,722 | 11/1961 | Ostergren | 273/145 C |
| 3,995,862 | 12/1976 | Bertin | 273/284 |

*Primary Examiner*—Richard C. Pinkham

*Assistant Examiner*—R. Carl Moy

*Attorney, Agent, or Firm*—Seed, Berry, Vernon & Baynham

[57] ABSTRACT

A board game of skill which has an upper transparent stationary surface, a transparent first movable underlying member with a partial direction-movement pattern, a lower opaque second underlying movable member which has a complimentary partial direction-movement pattern in one of a number of varied positions. The uppermost stationary transparent surface is provided with peg holes for moving pegs or pieces along color coded allowed direction-movement patterns formed by the two movable underlying members. Selection of the underlying member position to determine the alignment of the partial direction-movement patterns and the number of movements allowed is determined from random selection dice mounted in a centrally supported revolvable dice box.

5 Claims, 4 Drawing Figures

SKILL BOARD GAME

SUMMARY OF THE INVENTION

It is an object of this invention to provide a highly variable game board direction-moving pattern on a game board somewhat similar to Chinese checkers.

It is another object of this invention to provide a game having a high number of possible number and directional movements.

These objects are best obtained by providing a skill board game having a transparent upper board or planar member provided with a partial first allowed direction-movement pattern and at least one lower board or planar member movable relative to the upper planar member and having partial second allowed direction-movement pattern which compliments the partial first direction-movement pattern to provide a large variety of allowed direction movement patterns. Pieces are then moved in predetermined numbers determined from chance along the allowed direction-movement pattern.

In the preferred embodiment the movement of the pieces and the alignment pattern of the direction-movement patterns is determined from a rotatable three segmented dice box which is mounted accessible from all sides of the board in the center of the board. Also in the preferred embodiment the transparent upper planar member is positioned below a stationary transparent board or planar member which contains peg holes for allowing the pegs to be lined up with the pattern formed by the two lowermost boards. It should be understood, of course, that in its broadest form sliding pieces can be used on the stationary transparent board which in itself can be the upper planar member provided with the partial first allowed direction-movement patterns.

While the game is similar in many respects to the common game of Chinese checkers, it offers an infinitely greater number of possible movement combinations and, depending upon the rules selected, offers a wider choice of rewards and penalties during play.

DETAILED DESCRIPTION OF THE PREFERRED EMBODIMENTS

Figure 1:
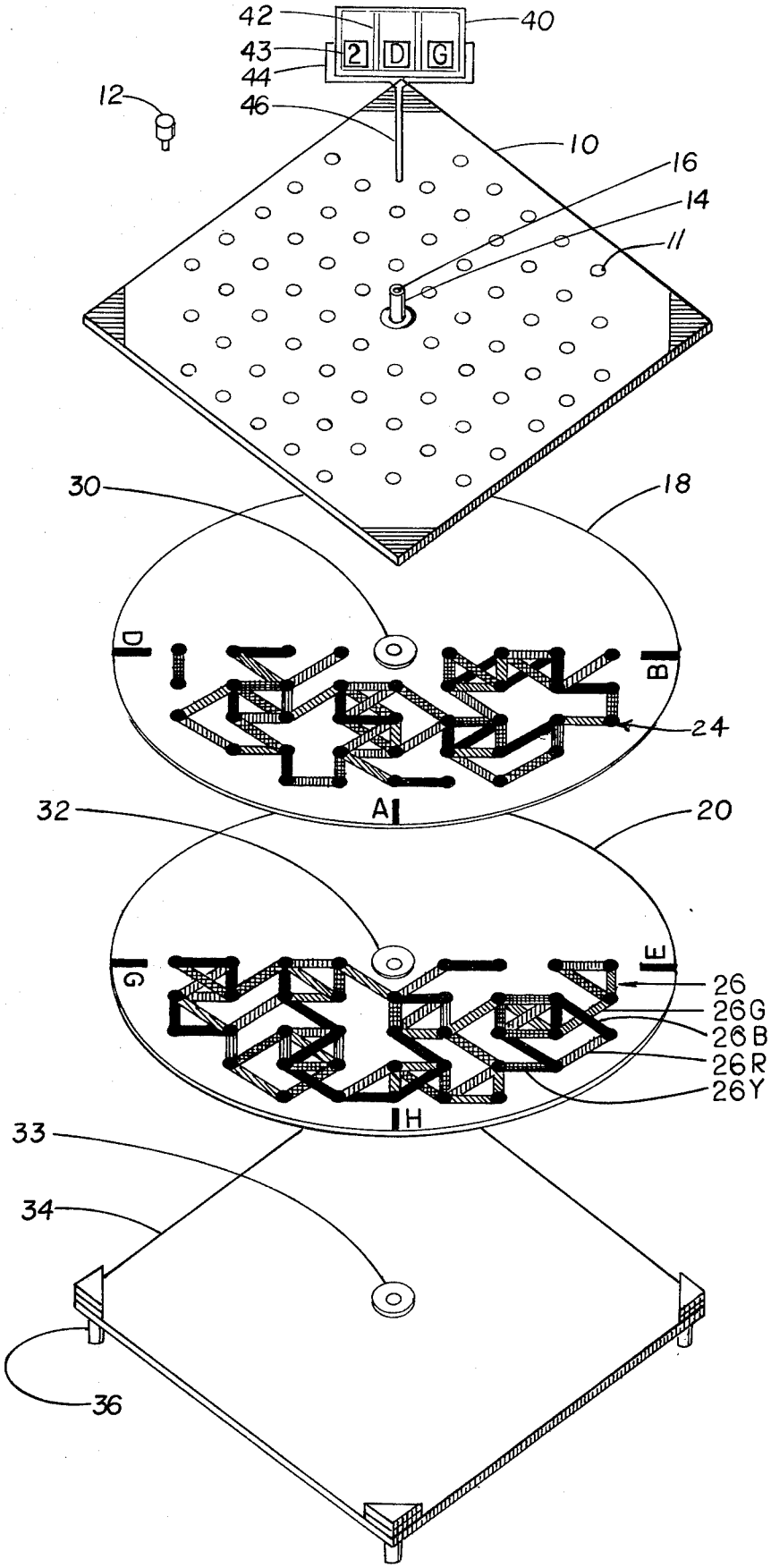
FIG. 1 illustrates an exploded overall isometric of the game embodying the principle of the invention.
Figure 2:
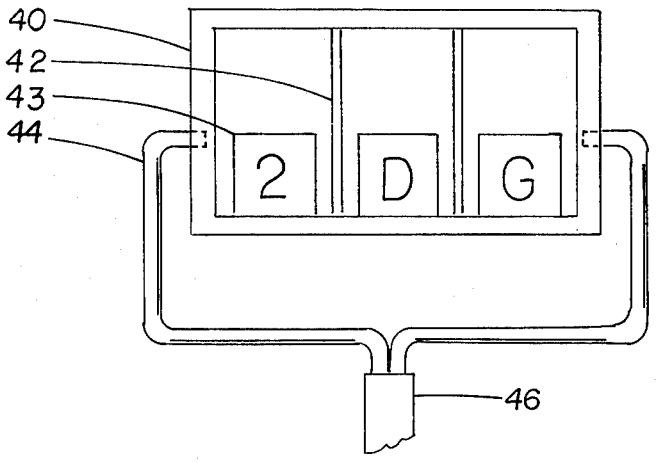
FIG. 2 is a partial front elevation of a dice holder embodying the principles of the invention.
Figure 4:
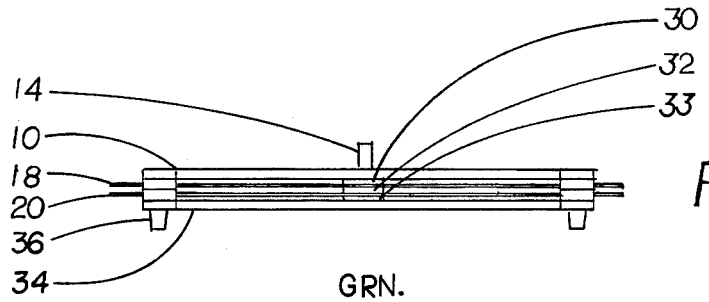
FIG. 4 is a partial front elevation of the assembled game.
Figure 3:
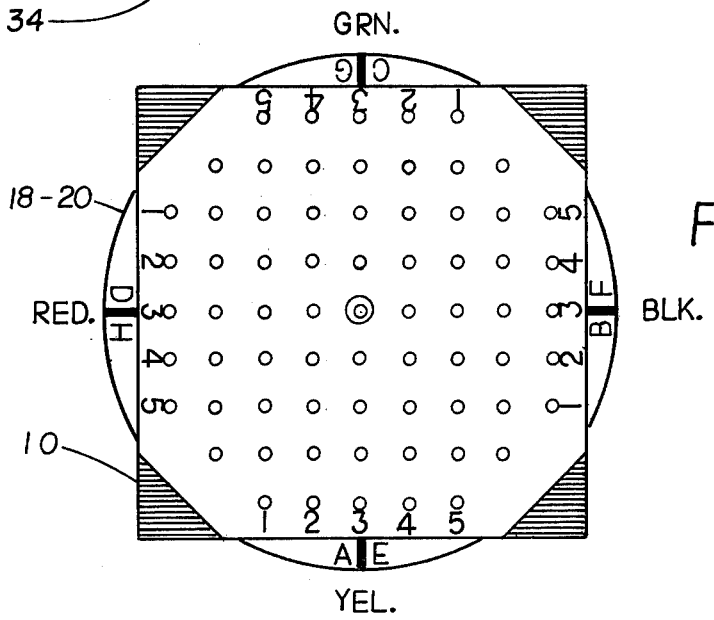
FIG. 3 is a partial plan of the assembled game.

The game, in the preferred embodiment, is provided with an upper transparent board 10 having a series of symmetrically located peg holes 11 including four rows of differently colored starting peg holes. Corresponding colored pegs 12 are fitted into the respective colored holes. The pegs are the movable pieces in the game. Mounted centrally in the stationary board is a pivot post 14 having a hollow bore 16. The pivot post extends downwardly from the stationary board and serves as a rotatable pivot for rotatable upper disc 18 and a rotatable lower disc 20. The upper disc 18 is transparent and is provided with partial first allowed direction-movement patterns 24 having colored segments. The upper transparent disc is also letter coded at its periphery with four letters A-D. The disc 18 is transparent so that the pattern of movements from below can be aligned with the patterns of the disc 18.

The lower disc 20 is preferably opaque and is also provided with partial allowed direction-movement patterns 26 having segments in different colors, namely, 26B, 26Y, 26G and 26R. The shading on the patterns of both discs is the same as for the example shown is on disc 20. The periphery of the lower disc 20 is also color coded with the letters E-H. When the two discs are in an alignment such that the letter of one disc is aligned with the letter of another disc the combined pattern of the partial allowed direction-movement patterns produce various same color paths linked together so that a number of moves of the pegs will follow the linked-together same colored segments. In other instances the identical color segments are not linked so that an attempted move staying on the same color path is blocked.

The discs are spaced from one another by spacers 30 and 32 and rest on a lower spacer 33 which is mounted on a lower stationary board or table 34. The table preferably is provided with legs 36 for supporting the boards on a level surface.

In order to determine the number of moves allowed and the alignment of the two movable discs, the board is provided with a rectangular box 40 having three divided compartments 42 in each of which is a die 43 having only four sides marked. One die is a numbered die for indicating numbers of movement whereas the other dice are lettered dice for indicating which of the letters on the two discs should be aligned with one another. The box is mounted for rotation to cause the dice to randomly rotate about horizontal axes only by a pivot bracket 44 mounted on a pedestal 46. The pedestal 46 fits in the bore 16 and can be rotated 360° about a vertical axis for ease of use by the players.

In the preferred embodiment the rules are as follows:

The colored pegs are placed in the peripheral peg holes and the pegs and peg holes at the periphery are numbered consecutively from 1 to 5. Each player spins the dice box or cube with the high number indicating the player to start the game. The starting player then spins the dice cube and turns the two rotating discs so the two letters selected by the dice are in alignment and centered in front of that player's starting area facing that player. A peg or pegs are then moved not to exceed the number of moves indicated by the dice. If the total quantity of moves allowed by the dice are not possible or desirable, the play rotates to the next player to the left. A player has the option to decline to move the pegs. A player is permitted to move the pegs between peg holes only when the peg holes are connected with color lines corresponding to the player's own colored pegs. A player may move the pegs in any desired direction, straight or diagonally forward, sideways or straight or diagonally backwards. When jumping an opponent peg, the peg hole occupied by an opponent is not counted—jumping an opponent peg requires only a one count move. Jumping an opponent peg must be done on a forward move, either straight or diagonally. An opponent peg can be jumped on a sideways move provided the jump is preceded or followed by a forward move either straight or diagonally. A player can only jump an opponent peg if it is located in the center peg hole of a set of three peg holes in straight alignment, and the three peg holes are joined with the moving player's own color lines. A player's peg which has been jumped must be returned to its original starting position, where it must begin play again. If that particular numbered starting position peg hole corresponding to that peg number is occupied by a peg, the jumped peg will remain in place on the playing board and continue in play. The game is terminated, and the winner indicated when one player has relocated all the pegs into the opposite player's starting peg holes, with corresponding numbers.

The dice cube must stop with the cube indicating cube indicating arrow pointing towards the player spinning the cube and the dice resting in the bottom of the cube with the dice angling upwards facing the player spinning the cube. If the dice cube or any dice stop in an improper position, the cube must be spun again. All the peg holes are connected to an adjacent peg hole in each color line and each playing pattern equally. There are sixteen different patterns of play from each of the four starting positions. The patterns are identical and equal from each of the four playing positions at the same time. That is, whatever playing pattern faces one player, the same pattern faces each other player in his own color at the same time.

While the preferred embodiments of the invention have been illustrated and described, it should be understood that variations will be apparent to one skilled in the art without departing from the principles herein. Accordingly, the invention is not to be limited to the specific embodiment illustrated in the drawings.

We claim:

1. A skill board game having a transparent upper planar member provided with a partial first allowed direction-movement pattern, and at least one lower planar member underlying the upper planar member and having a partial second allowed direction-movement pattern which complements the direction-movement pattern of the upper planar member, said planar members being movable to change the alignment of the direction movement patterns between the two planar members for varying the combined allowed direction of movement, a stationary transparent top board having piece receiving indicia, and revealing the patterns of said upper and lower planar members, pieces movable along the top board for following the allowed direction-movement pattern, and means for selecting the choice of alignment between the two planar members and the number of moves allowed for the pieces, the partial first and second allowed direction-movement patterns each including a series of independent segments arranged in random directions and in random multiples of allowed interconnected segments wherein a partially completed random path of more than one segment interconnected in more than one direction is provided by combining vertically and horizontally overlying and visually interconnected segments with each selection of alignment between the upper and lower planar members whereby a movement of a piece on the top transparent board following the pattern of partial first and second allowed direction-movement interconnected segments can be moved in varying directions and in varying numbers of segments dependent upon the means for selecting the number of moves allowed and selecting the planar member alignment.

2. The game of claim 1 wherein the allowed allowed-divertion patterns in only alignment are identical at each of the four color player positions so that the no player has an advantage because of alignment patterns.

3. The game of claim 1, wherein said top board includes peg holes in a symmetrical pattern including peripheral equidistantly spaced sets of home holes.

4. The game of claim 1, said transparent top board including a vertical pivot post, a pedestal mounted for rotation about a vertical axis in said post, a dice box mounted on said pedestal for rotation about a horizontal axis, said dice box being divided into three compartments each of a width less than the diagonal of a die, and a die in each compartment such that tumbling of the dice can occur only in one plane, and including indicia on the dice on faces perpendicular to that plane.

5. A skill board game comprising:

a stationary transparent top board having peg holes in a symmetrical pattern including peripheral equidistantly spaced sets of home holes in four color areas, a transparent rotatable upper planar member provided with a partial first allowed direction-movement pattern, a lower planar member underlying the upper planar member and being coaxially rotatable therewith beneath said stationary top board and having a partial second allowed direction-movement pattern which complements the direction-movement pattern of the upper planar member, said upper and lower planar members being movable to change the alignment of the partial direction-movement patterns between the two planar members as viewed through the stationary top board for varying the combined allowed direction of movement, the partial first and second allowed direction-movement patterns each including a series of independent segments arranged in random directions and in random multiples of allowed interconnected segments wherein a partially completed random path of more than one segment and more than one direction is provided by combining vertically and horizontally overlying and visually interconnected segments with each selection of alignment between the upper and lower planar members whereby a movement of a piece on the top board following the partial first and second allowed direction-movement pattern can be moved in varying directions and in varying numbers of segments dependent upon the means for selecting the number of moves allowed and the choice of alignment, a vertical pivot post, on said transparent upper planar member, a pedestal centrally and rotatably mounted about a vertical axis in said post, a dice box mounted on said pedestal for rotation about a horizontal axis, said dice box being divided into three compartments each of a width less than the diagonal of a die, and a die in each compartment such that tumbling of the dice can occur only in one plane and indeces on the dice on faces perpendicular to that plane, pieces movable along the top board for following the allowed direction-movement pattern, said allowed direction-movement patterns in any alignment being identical in each of the four color player areas, and means for selecting the choice of alignment between the two planar members and the number of moves allowed for pieces.

* * * * *